US012011036B2

(12) United States Patent
Qiu et al.

(10) Patent No.: US 12,011,036 B2
(45) Date of Patent: Jun. 18, 2024

(54) CARTRIDGE AND ELECTRONIC CIGARETTE

(71) Applicant: CHANGZHOU PATENT ELECTRONIC TECHNOLOGY CO., LTD, Changzhou (CN)

(72) Inventors: Weihua Qiu, Jiangsu (CN); Zhencai Zhou, Jiangsu (CN)

(73) Assignee: CHANGZHOU PATENT ELECTRONIC TECHNOLOGY CO., LTD, Changzhou (CN)

( * ) Notice: Subject to any disclaimer, the term of this patent is extended or adjusted under 35 U.S.C. 154(b) by 646 days.

(21) Appl. No.: 17/237,086

(22) Filed: Apr. 22, 2021

(65) Prior Publication Data

US 2021/0235756 A1 Aug. 5, 2021

Related U.S. Application Data

(63) Continuation-in-part of application No. PCT/CN2019/110691, filed on Oct. 12, 2019.

(30) Foreign Application Priority Data

Oct. 22, 2018 (CN) ..... 201811229017.9
Oct. 22, 2018 (CN) ..... 201821716152.1

(51) Int. Cl.
*A24F 40/42* (2020.01)
*A24F 40/10* (2020.01)

(52) U.S. Cl.
CPC ..... *A24F 40/42* (2020.01); *A24F 40/10* (2020.01)

(58) Field of Classification Search
CPC ..... A24F 40/42; A24F 40/10
See application file for complete search history.

(56) References Cited

U.S. PATENT DOCUMENTS 10,772,353 B2 * 9/2020 Liu ..... H05B 3/04

FOREIGN PATENT DOCUMENTS

CA 2977585 A1 9/2016
CN 104397875 A 3/2015
(Continued)

OTHER PUBLICATIONS

International Search Report of PCT Patent Application No. PCT/CN2019/110691 dated Feb. 28, 2020.

*Primary Examiner* — Ross N Gushi
(74) *Attorney, Agent, or Firm* — Andrew C. Cheng

(57) ABSTRACT

A cartridge includes a liquid storage assembly, a connecting assembly, and an atomizing assembly. The connecting assembly is connected to the lower end of the liquid storage assembly. The atomizing assembly is received in the connecting assembly. The atomizing assembly includes an atomizing base, a liquid absorbing member, and a heating member. The upper end surface of the atomizing base is recessed downward to form a mounting groove. The liquid absorbing member is received in the mounting groove. The heating member is located above the mounting groove of the atomizing base corresponding to the liquid absorbing member, and the heating member presses and fixes the liquid absorbing member in the mounting groove. The liquid storage chamber is in fluid communication with the liquid absorbing member. The cartridge is convenient to replace the entire atomizing assembly or replace the liquid absorbing member and the heating member individually.

20 Claims, 9 Drawing Sheets

(56) References Cited

FOREIGN PATENT DOCUMENTS

| | | | |
|---|---|---|---|
| CN | 204519374 | U | 8/2015 |
| CN | 205143489 | U | 4/2016 |
| CN | 206043440 | U | 3/2017 |
| CN | 209314954 | U | 8/2019 |
| WO | 2016050244 | A1 | 4/2016 |

* cited by examiner

CARTRIDGE AND ELECTRONIC CIGARETTE

CROSS-REFERENCE TO RELATED APPLICATIONS

This application is a continuation-in-part of International patent application No. PCT/CN2019/110691, filed on Oct. 12, 2019, entitled "cartridge and electronic cigarette", which claims priority to Chinese patent application No. 201821716152.1 and Chinese patent application No. 201811229017.9, both of which are filed on Oct. 22, 2018. All of the aforementioned patent applications are hereby incorporated by reference in their entireties.

TECHNICAL FIELD

The present disclosure relates to the technical field of simulated smoking, and more particularly, relates to a cartridge and an electronic cigarette having the cartridge.

BACKGROUND

Existing electronic cigarettes generally include a cartridge and a power supply device electrically connected to the cartridge. The cartridge includes a liquid storage assembly for storing e-liquid and an atomizing assembly for atomizing e-liquid, and its overall structure is complicated, it is not easy to disassemble, and it is inconvenient to replace parts. In addition, after a long time of use, the heating member on the atomizing assembly is easily carbonized, and the liquid absorbing member is easily blocked by carbon slag. Therefore, the user needs to replace the heating member and the liquid absorbing member in time. However, the components on the atomizing assembly are press-fitted and have a high degree of integration, it is not easy for users to disassemble, and it is impossible to replace the heating member or the liquid absorbing member individually. Only the atomizing assembly as a whole can be replaced, which causes material waste and increases the use and maintenance costs.

SUMMARY

Based on the above, it is necessary to provide a cartridge that is easy to disassemble and easy to replace the atomizing assembly and its internal components.

It is also necessary to provide an electronic cigarette having the cartridge.

The technical solution adopted by the present disclosure to solve its technical problems is as follows.

According to a first aspect of the present disclosure, a cartridge is provided. The cartridge includes a liquid storage assembly, a connecting assembly, and an atomizing assembly. The connecting assembly is connected to a lower end of the liquid storage assembly. The atomizing assembly is received in the connecting assembly. The atomizing assembly includes an atomizing base, a liquid absorbing member, and a heating member. An upper end surface of the atomizing base is recessed downward to form a mounting groove. The liquid absorbing member is received in the mounting groove. The heating member is located above the mounting groove of the atomizing base corresponding to the liquid absorbing member, and the heating member presses and fixes the liquid absorbing member in the mounting groove. The liquid storage member is in fluid communication with the liquid absorbing member.

Further, the atomizing base is provided with a mounting hole on one side of the mounting groove. The heating member is connected with a pin corresponding to the mounting hole. One end of the pin passes through the mounting hole and is bent.

Further, the connecting assembly includes a connecting sleeve and a connecting member received in the connecting sleeve. The connecting sleeve is sleeved around the liquid storage assembly. A receiving groove is provided in the connecting member. The atomizing base is received in the receiving groove.

Further, the liquid storage assembly includes an end cover. The end cover is provided with a connecting tube. One end of the connecting tube is in communication with the liquid storage chamber, and the other end of the connecting tube passes through the connecting member and abuts against the liquid absorbing member.

Further, the liquid storage assembly includes a tail cap. The connecting assembly further includes an end cover connected with the connecting member. The end cover is provided with a connecting tube. One end of the connecting tube is inserted into the tail cap and is in communication with the liquid storage chamber, and the other end of the connecting tube abuts against the liquid absorbing member.

Further, the tail cap is provided with a liquid outlet through hole. A sealing member for sealing the liquid storage chamber is installed in the liquid outlet through hole. After one end of the connecting tube is inserted into the liquid outlet through hole and passes through the sealing member, the liquid storage chamber is in communication with the connecting tube.

Further, the liquid storage assembly includes a liquid storage tube. The connecting sleeve is sleeved around the liquid storage tube. The liquid storage tube is provided with an air inlet passage and an air outlet passage. The air inlet passage and the air outlet passage are each spaced apart from the liquid storage chamber. The liquid storage tube is further provided with an air inlet hole and an air outlet hole. The air inlet passage is in communication with the air inlet hole and the receiving groove. The air outlet passage is in communication with the air outlet hole and the receiving groove.

Further, the connecting member is provided with a U-shaped connecting passage therein. Two opposite ends of the connecting passage are respectively in communication with the air inlet passage and the air outlet passage. The lower end of the connecting passage is in communication with the receiving groove. A portion of the inlet passage and a portion of the air outlet passage are blocked by the part of the connecting member that is surrounded by the connecting passage.

According to a second aspect of the present disclosure, an electronic cigarette is provided. The electronic cigarette includes a cartridge as mentioned above.

Further, the electronic cigarette further includes a power supply device. The power supply device is electrically connected to atomizing assembly. The connecting assembly is detachably connected to the power supply device.

The present disclosure further provides an atomizing device for electronic cigarettes. The atomizing device includes a power supply device, an atomizing assembly, and a connecting assembly. The connecting assembly includes a connecting sleeve with a cavity therein and a cartridge connecting seat connected to one end of the power supply device. The connecting sleeve is detachably connected to the cartridge connecting seat. An upper end of the connecting sleeve and an upper end of the cartridge connecting seat are spaced apart along a longitudinal axis of the power supply device. The atomizing assembly is at least partially received in the space between the upper end of the connecting sleeve and the upper end of the cartridge connecting seat.

Further, the connecting assembly further includes a connecting member received in the connecting sleeve. The connecting member is detachably connected to the cartridge connecting seat. The atomizing assembly is at least partially received in the space between a lower end of the connecting member and the upper end of the cartridge connecting seat.

Further, a lower end surface of the connecting member is recessed upward to form a receiving groove, and the atomizing assembly is received in the receiving groove. The connecting member and the cartridge connecting seat are connected by threads.

Further, an inner cavity of the connecting member forms a receiving groove. The atomizing assembly is engaged with an inner surface of the cartridge connecting seat. The connecting member is engaged with an outer surface of the cartridge connecting seat.

Further, the atomizing assembly includes an atomizing base received in the space between the lower end of the connecting member and the upper end of the cartridge connecting seat, and a heating member installed on the atomizing base. The power supply device further includes a battery, and two ends of the heating member are electrically connected to the positive and negative electrodes of the battery, respectively.

An electronic cigarette includes an atomizing device for electronic cigarettes as mentioned above.

Further, the electronic cigarette further includes a liquid storage assembly detachably connected with the connecting assembly. The liquid storage assembly includes a liquid storage tube. The outer circumferential surface of the liquid storage tube is protruded to provide with a limiting portion. The upper end of the connecting sleeve is engaged with the limiting portion, the connecting sleeve is sleeved around the liquid storage tube, and the upper end of the connecting sleeve abuts against the limiting portion.

Further, one of the inner wall of the connecting sleeve and the outer wall of the liquid storage tube is provided with a locking protrusion, and the other one is provided with a locking groove engaged with the locking protrusion.

Further, the liquid storage tube is provided with a liquid storage chamber therein. The atomizing assembly includes a liquid absorbing member. A connecting tube is provided between the liquid storage tube and the atomizing assembly. One end of the connecting tube is in communication with the liquid storage tube, and the other end of the connecting tube abuts against the liquid absorbing member.

Further, the liquid storage assembly is provided with a liquid outlet through hole in communication with the liquid storage chamber. A sealing member for sealing the liquid storage chamber is installed in the liquid outlet through hole. When the liquid storage assembly and the connecting assembly are installed in place, the connecting tube is inserted into the liquid outlet through hole and passes through the sealing member, and the liquid storage chamber is in communication with the connecting tube.

Further, the connecting sleeve is provided with a notch, and the notch extends from the upper end of the connecting sleeve towards the lower end of the connecting sleeve. After the liquid storage assembly is installed on the connecting assembly, the e-liquid in the liquid storage assembly can be observed through the notch.

The beneficial effects of the present disclosure are: in the cartridge or the electronic cigarette provided by the present disclosure, when the atomizing assembly needs to be replaced, the atomizing assembly can be taken out by releasing the connection between the connecting assembly and the power supply device. Further, it is convenient to disassemble and replace the liquid absorbing member and the heating member of the atomizing assembly individually, which reduces material waste and saves costs. In addition, when the e-liquid in the liquid storage member is used up, the user can drop e-liquid onto the liquid absorbing member 32 after the liquid storage member is pulled out, so that the electronic cigarette can be used continuously to realize the functions of a liquid storage type electronic cigarette and a dripping type electronic cigarette respectively, and the user experience is improved.

BRIEF DESCRIPTION OF THE DRAWINGS

The present disclosure will be further described hereinafter with reference to the drawings and the embodiments.

Figure 1:
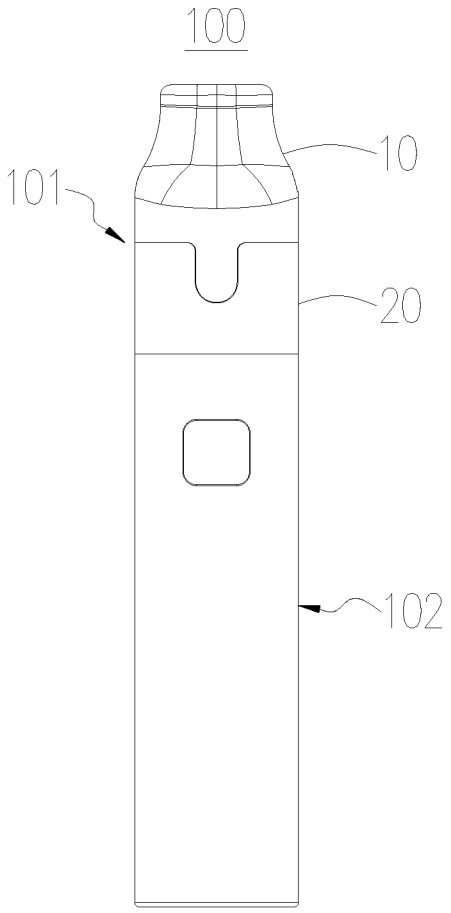
FIG. 1 is a perspective view of an electronic cigarette according to the first embodiment of the present disclosure.

The reference numerals for various components in the drawings are as follow:

| | |
|---|---|
| electronic cigarette 100, 200 | cartridge 101 |
| liquid storage tube 11 | liquid storage chamber 110 |
| air outlet passage 112 | air inlet hole 113 |
| end cover 12, 23 | connecting tube 121, 231 |
| second through hole 123 | tail cap 13 |
| air inlet through hole 132 | air outlet through hole 133 |
| connecting sleeve 21 | receiving groove 220 |
| sealing ring 222 | connecting passage 223 |
| atomizing assembly 30 | atomizing base 31 |
| mounting hole 311 | liquid absorbing member 32 |
| pin 331 | power supply device 102 |
| battery 1022 | cartridge connecting seat 1023 |
| second electrode 1025 | sealing gasket 24 |
| window 115 | connecting member 22 |
| liquid storage assembly 10 | mounting groove 310 |
| air inlet passage 111 | heating member 33 |
| air outlet hole 114 | casing 1021 |
| first through hole 122 | first electrode 1024 |
| liquid outlet through hole 131 | notch 211 |
| connecting assembly 20 | |
| through hole 221 | |

DETAILED DESCRIPTION OF PREFERRED EMBODIMENTS

The present disclosure will now be described in detail with reference to the drawings. These drawings are simplified schematic diagrams, which only illustrate the basic structure of the present disclosure in a schematic way, so it only shows the construction related to the present disclosure.

First Embodiment

Figure 2:
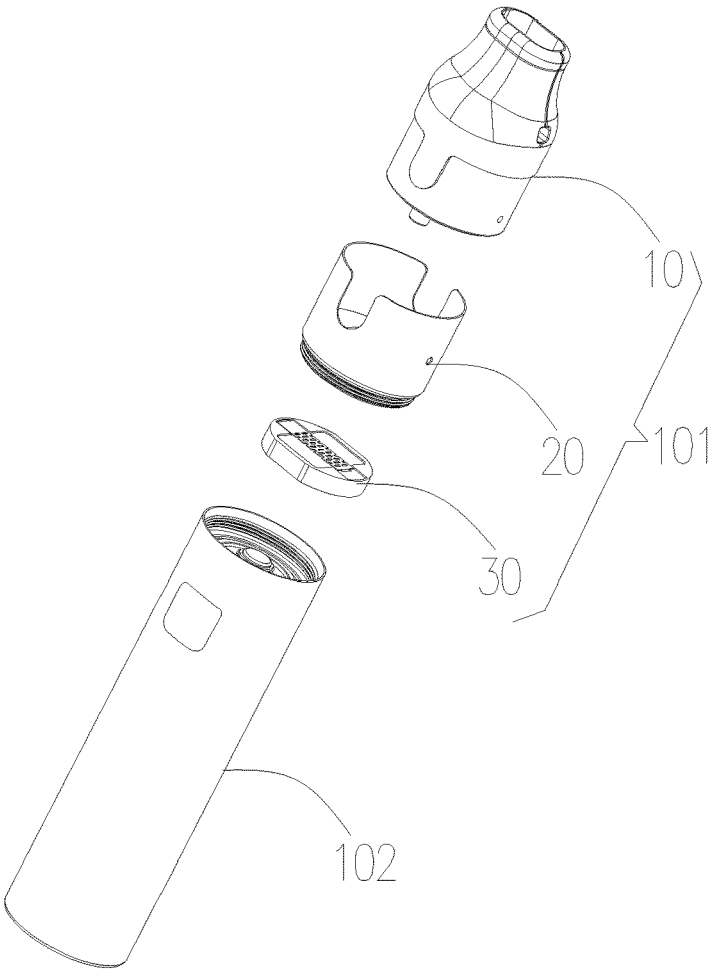
FIG. 2 is a partially exploded view of the electronic cigarette shown in FIG. 1.

Please refer to FIG. 1 and FIG. 2, the first embodiment of the present disclosure provides an electronic cigarette 100, the electronic cigarette 100 includes a cartridge 101 and a power supply device 102 electrically connected to the cartridge 101. The cartridge 101 includes a liquid storage assembly 10, a connecting assembly 20 sleeved around the liquid storage assembly 10, and an atomizing assembly 30 received in the connecting assembly 20. The power supply device 102 is connected to the connecting assembly 20. In use, the e-liquid stored in the liquid storage assembly 10 flows into the atomizing assembly 30, and the power supply device 102 supplies power to the atomizing assembly 30, so that the e-liquid is heated by the atomizing assembly 30 to generate smoke, and the smoke can be inhaled by the user, wherein the connecting assembly 20, the atomizing assembly 30 and the power supply device 102 jointly constitute an atomizing device (not labelled).

Please refer to FIGS. 1, 2, 4, and 5, in this embodiment, the connecting assembly 20 of the atomizing device for electronic cigarettes includes a connecting sleeve 21 with a cavity therein and a cartridge connecting seat 1023 connected to one end of the power supply device 102. The connecting sleeve 21 is detachably connected to the cartridge connecting seat 1023, for example, by means of snapping connection or threaded connection, etc. The upper end of the connecting sleeve 21 and the upper end of the cartridge connecting seat 1023 are spaced apart along the longitudinal axis of the power supply device 102. The atomizing assembly 30 is at least partially received in the space between the upper end of the connecting sleeve 21 and the upper end of the cartridge connecting seat 1023. The upper end, lower end, etc. mentioned herein refer to the reference direction in normal use of the electronic cigarette, for example, when the electronic cigarette is placed on the desktop or held by the user, rather than an absolute definition.

Figure 3:
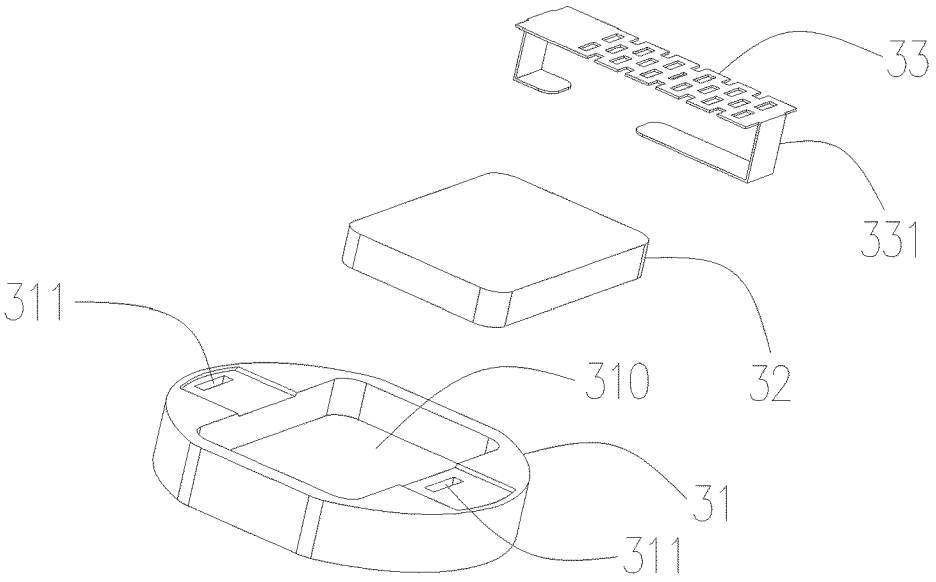
FIG. 3 is an exploded view of the atomizing assembly of the electronic cigarette shown in FIG. 1.
Figure 4:
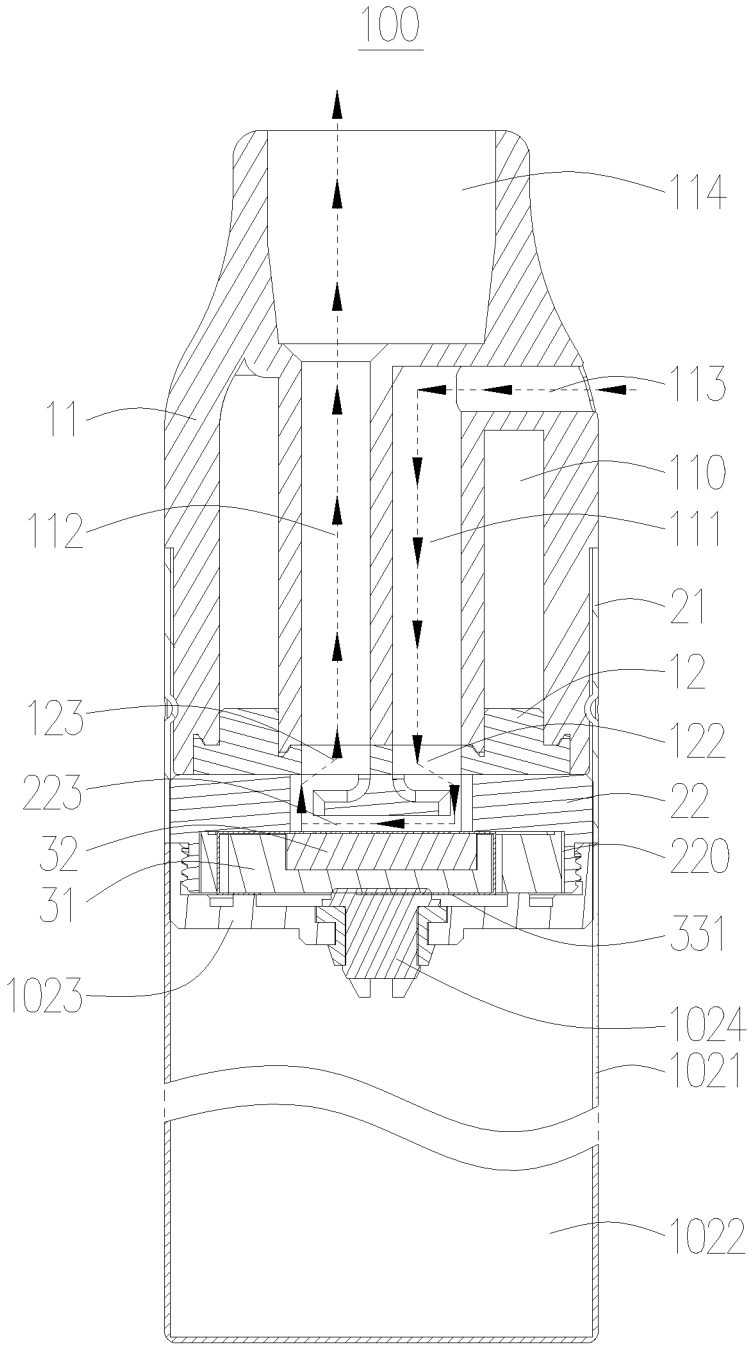
FIG. 4 is a cross-sectional view of the electronic cigarette shown in FIG. 1.

Referring to FIGS. 3 and 4, the liquid storage assembly 10 includes a liquid storage tube 11 and an end cover 12 provided at the lower end of the liquid storage tube 11.

The liquid storage tube 11 includes an upper section and a lower section connected to the upper section. The inner diameter of the upper section is smaller than that of the lower section. The lower end surface of the liquid storage tube 11 is recessed upward along the axial direction of the liquid storage tube 11 to form an annular cavity. The annular cavity constitutes a liquid storage chamber 110 for storing e-liquid. The upper end of the liquid storage chamber 110 is closed, and the lower end of the liquid storage chamber 110 is an open end. The liquid storage tube 11 is provided with an air inlet passage 111 and an air outlet passage 112 therein, which are also provided along the axial direction of the liquid storage tube 11. The air inlet passage 111 and the air outlet passage 112 are each spaced apart from the liquid storage chamber 110. The side wall of the liquid storage tube 11 is provided with an air inlet hole 113 along the radial direction of the liquid storage tube 11. An air outlet hole 114 is provided on the upper end surface of the liquid storage tube 11. The air inlet hole 113 is in communication with the outside atmosphere and the upper end of the air inlet passage 111, and the lower end of the air inlet passage 111 extends through the lower end surface of the liquid storage tube 11. The lower end of the air outlet passage 112 extends through the lower end surface of the liquid storage tube 11, and the upper end of the air outlet passage 112 is in communication with the air outlet hole 114. When the user inhales, the outside air enters through the air inlet hole 113, and then sequentially passes through the air inlet passage 111 and the air outlet passage 112, and finally the generated smoke is brought into the user's mouth through the air outlet hole 114.

It can be understood that, during the user's suction process, the hot airflow in the air outlet passage 112 can preheat the e-liquid in the liquid storage chamber 110, so that the e-liquid has a relatively high temperature before it enters the atomizing assembly 30, which can enhance the e-liquid atomizing efficiency and reduce energy consumption at the same time.

The end cover 12 has a substantially circular-shaped plate structure. The end cover 12 is hermetically installed at the lower open end of the liquid storage chamber 110. In this embodiment, the lower end surface of the end cover 12 extends downward along the axial direction of the end cover 12 to form two oppositely arranged connecting tubes 121. Each connecting tube 121 is opened at both ends and is in communication with the liquid storage chamber 110.

The connecting assembly 20 includes a connecting sleeve 21 and a connecting member 22 installed in the lower end of the connecting sleeve 21. The connecting sleeve 21 is substantially a hollow cylindrical structure with both ends being opened. The connecting sleeve 21 is sleeved around the lower end of the liquid storage tube 11. When installing the liquid storage assembly 10, only the lower end of the liquid storage tube 11 needs to be inserted into the connecting sleeve 21. In addition, one of the inner wall of the connecting sleeve 21 and the outer wall of the liquid storage tube 11 is provided with a locking protrusion (not labelled), the other one is provided with a locking groove (not labelled) to be engaged with the locking protrusion. The engagement relationship between the locking protrusion and the locking groove can further improve the connection stability between the connecting assembly 20 and the liquid storage assembly 10.

In addition, the liquid storage tube 11 is made of transparent or translucent material, so that the user can observe the residual amount of e-liquid in the liquid storage chamber 110 through the liquid storage tube 11, and facilitate the user to replace the liquid storage tube 11 in time. The outer circumferential surface of the liquid storage tube 11 is protruded to provide with a limiting portion (not labelled). The upper end of the connecting sleeve 21 is engaged with the limiting portion. When the connecting sleeve 21 is installed in place, the limiting portion abuts against the upper end of the connecting sleeve 21 to provide a limiting function to the installation of the liquid storage tube 11. In this embodiment, the lower end of the limiting portion is set in a wavy curved shape, to provide play a positioning function for the liquid storage tube 11 to prevent the liquid storage tube 11 and the connecting sleeve 21 from rotating with each other. The locking protrusion is provided at the lower end of the limiting portion, and the locking groove is provided on the inner wall of the connecting sleeve 21.

The connecting member 22 is installed in the lower end of the connecting sleeve 21 by interference fit, and abuts against the end cover 12. The connecting member 22 has a substantially plate-like structure. The lower end of the connecting member 22 is threadedly fitted with the upper end of the power supply device 102, so as to achieve a fixed connection relationship between the connecting assembly 20 and the power supply device 102. It can be understood that, in other embodiments not shown, the connecting member 22 and the power supply device 102 may also be detachably connected by snapping connection, plugging connection, or magnetic connection, which is not limited here.

Please refer to FIG. 4 again, the lower end surface of the connecting member 22 is recessed upward to form a receiving groove 220. The atomizing assembly 30 is received in the receiving groove 220. Please refer to FIG. 5 again, the upper end surface of the connecting member 22 is provided with two oppositely arranged through holes 221 corresponding to the two connecting tubes 121. Each through hole 221 constitutes a liquid outlet through hole in communication with the liquid storage chamber 110. The lower end of the connecting tube 121 passes through the through hole 221 and then abuts against the atomizing assembly 30, so that the e-liquid in the liquid storage chamber 110 can flow into the atomizing assembly 30 through the connecting tubes 121 to be heated to generate smoke. In order to avoid the leakage of e-liquid, a sealing ring 222 is sandwiched between the inner wall of the through hole 221 and the outer wall of the connecting tube 121. It can be understood that, the material of the sealing ring 222 includes, but is not limited to, silicone or rubber.

In addition, please refer to FIG. 4 again, the connecting member 22 is provided with a U-shaped connecting passage 223 therein. One end of the connecting passage 223 is in communication with the air inlet passage 111, and the other end of the connecting passage 223 is in communication with the air outlet passage 112. The lower end of the connecting passage 223 is in communication with the receiving groove 220. A portion of the air inlet passage 111 and a portion of the air outlet passage 112 are blocked by the part of the connecting member 22 that is surrounded by the connecting passage 223, so as to block the tiny e-liquid particles splashed during atomization, avoid scalding the user, and improve the safety of use. In order to facilitate air flowing through the end cover 12, the end cover 12 is provided with a first through hole 122 and a second through hole 123 therein, wherein the first through hole 122 is in communication with one end of the connecting passage 223 and the air inlet passage 111, and the second through hole 123 is in communication with the other end of the connecting passage 223 and the air outlet passage 112. The direction indicated by the dashed arrows in FIG. 4 is the airflow direction.

Please refer to FIGS. 3 and 4, the atomizing assembly 30 includes an atomizing base 31, a liquid absorbing member 32 received in the atomizing base 31, and a heating member 33 installed on the atomizing base 31.

The atomizing base 31 is substantially in the shape of a circular plate. The upper end surface of the atomizing base 31 is recessed downward to form a mounting groove 310. The liquid absorbing member 32 is received in the mounting groove 310. The heating member 33 is located above the mounting groove 310 of the atomizing base 31 corresponding to the liquid absorbing member 32, and the heating member 33 presses and fixes the liquid absorbing member 32 in the mounting groove 310. The atomizing base 31 is provided with mounting holes 311 on opposite sides of the mounting groove 310. Two pins 331 are connected to two ends of the heating member 33, each pin 331 corresponds to one mounting hole 311. The two pins 331 pass through the corresponding mounting holes 311, and then are bent in facing directions and attached to the atomizing base 31. At this time, due to the bending of the pins 331, the heating member 33 is not easy to be drawn out, so that the heating member 33 is fixed on the atomizing base 31, to effectively prevent the heating member 33 from loosening, and the operation is simple and convenient to use. Also, it is ensured that the liquid absorbing member 32 and the heating member 33 are in contact with each other closely, and the atomizing efficiency of the e-liquid is improved. It can be understood that, in other embodiments not shown, there may be only one mounting hole 311; correspondingly, there is only one pin 331. At this time, the one pin 331 of the heating member 33 passes through the mounting hole 311 and then is bent, which can also fix the heating member 33.

In one of the embodiments not shown, the lower end of the connecting tube 121 is pre-sealed with a sealing member (not shown). In other words, before the liquid storage assembly 10 and the atomizing assembly 30 are installed together, the e-liquid in the liquid storage assembly 10 is isolated from the outside world. The sealing member can be an aluminum foil or other similar metal film, or plastic film. After the liquid storage assembly 10 is installed onto the atomizing assembly 30, a piercing member (not shown) provided on the atomizing base 31 pierces the sealing member to destroy the sealing effect, so as to introduce the e-liquid in the liquid storage assembly 10 into the atomizing assembly 30, which is convenient to continuously heat and atomize the e-liquid after the atomizing assembly 30 is energized and activated. After the e-liquid in the liquid storage assembly 10 is used up, the liquid storage assembly 10 can be directly removed from the atomizing assembly 30, without the need to discard the electronic cigarette as a whole, which reduces the user's use cost.

It can be understood that, in other embodiments not shown, the piercing member is installed in the liquid outlet through hole. After the liquid storage assembly 10 and the connecting assembly 20 are installed in place, the connecting tube 121 serves as the piercing member to pierce the sealing member, so that the e-liquid can flow out of the liquid storage chamber 110.

In use, the power supply device 102 supplies power to the heating member 33, and the heating member 33 heats the e-liquid absorbed on the liquid absorbing member 32 after the heating member 33 is energized, so that the e-liquid generates smoke. In addition, the heating member 33 is provided with at least one smoke outlet hole (not shown). The smoke outlet hole is a through hole and is in communication with the connecting passage 223 to facilitate smoke to flow into the user's mouth after passing through the smoke outlet hole. When the user needs to replace the heating member 33 and the liquid absorbing member 32, the user only needs to straighten the pin 331, then pull out the heating member 33, and further take out the liquid absorbing member 32 from the mounting groove 310.

Figure 5:
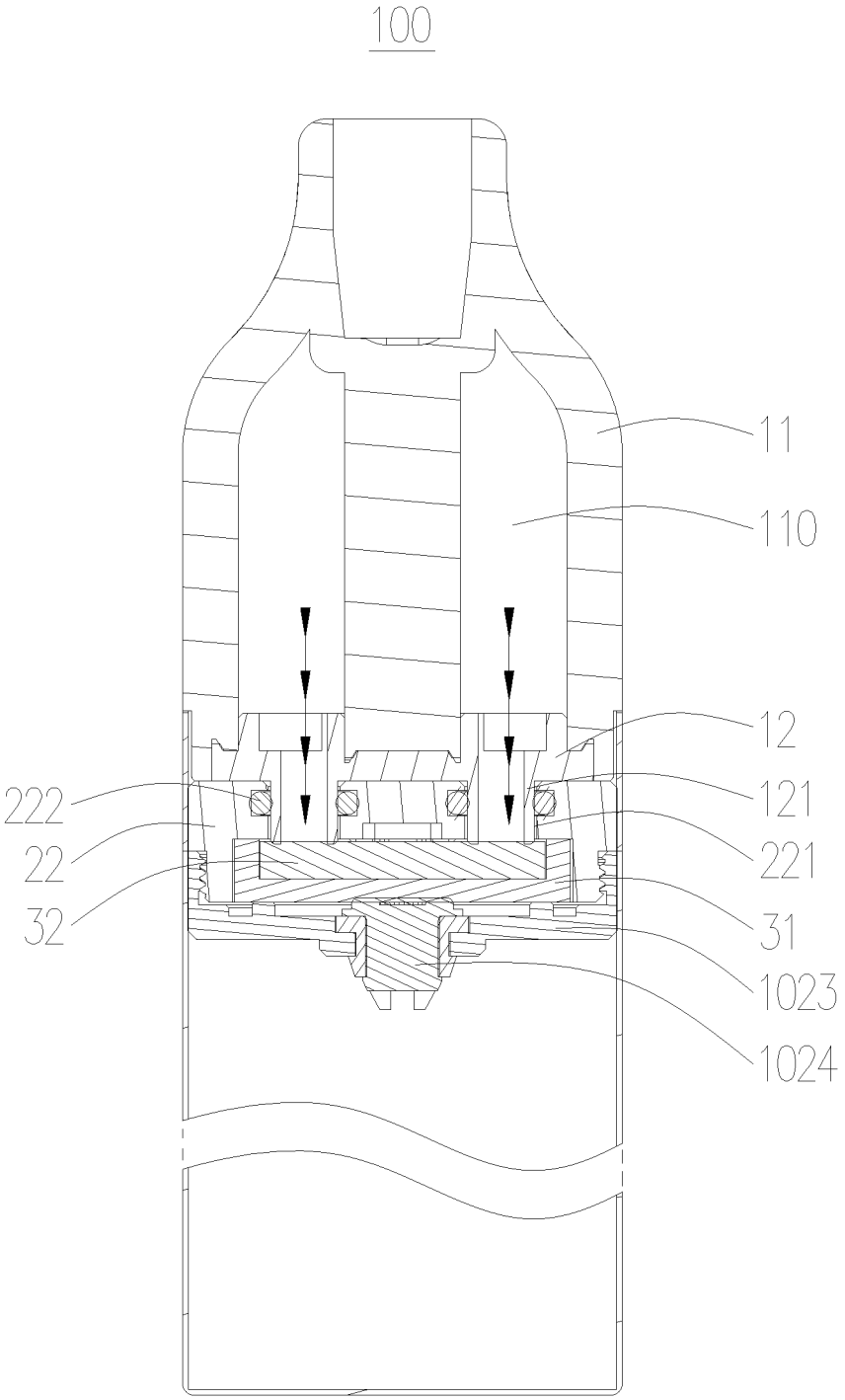
FIG. 5 is another cross-sectional view of the electronic cigarette shown in FIG. 1 (rotated by 90° relative to FIG. 4)

Specifically, the lower end of the connecting tube 121 passes through the through hole 221 of the connecting member 22 to abut against the liquid absorbing member 32, thereby ensuring that the e-liquid can be absorbed by the liquid absorbing member 32 in time, and the speed of absorbing the e-liquid is increased, and the leakage of the e-liquid is avoided. The direction indicated by the solid arrows in FIG. 5 is the flow direction of the e-liquid.

The liquid absorbing member 32 has the function of absorbing e-liquid. It can be understood that, the liquid absorbing member 32 is a porous liquid absorbing member. The liquid absorbing member 32 can be made of one, two or a combination of cotton, porous ceramic, fiber rope, foamed metal, and foamed graphite. In this embodiment, the liquid absorbing member 32 is cotton. The heating member 33 has a sheet-like structure, and the heating member 33 is completely received in the mounting groove 310 of the atomizing base 31, that is, the upper surface of the heating member 33 is lower than the upper surface of the atomizing base 31 or coplanar with the upper surface of the atomizing base 31. The heating member 33 is a heat-generating member that can be energized to generate heat. In this embodiment, the heating member 33 is a metal heating sheet, the heating member 33 and the pins 331 are integrally formed.

In this embodiment, the material of the atomizing base 31 is liquid-absorbing ceramic, which has liquid-absorbing ability and can absorb and store part of the e-liquid to effectively prevent dry burning. In this case, the atomizing base 31 not only has the function of installing the liquid absorbing member 32, but also has the function of liquid absorption. It can be understood that, when the atomizing base 31 is made of liquid-absorbing ceramic, since the pins 331 are attached to the atomizing base 31, the pins 331 can heat the e-liquid absorbed in the liquid-absorbing ceramic, thereby further improving the atomizing efficiency.

Please refer to FIG. 4 again, the power supply device 102 includes a casing 1021, a battery 1022 received in the casing 1021, a cartridge connecting seat 1023 installed at one end of the casing 1021, and a first electrode 1024 mounted on the cartridge connecting seat 1023. The cartridge connecting seat 1023 and the connecting member 22 are detachably connected, the first electrode 1024 is electrically connected to one of the positive and negative electrodes of the battery 1022. The cartridge connecting seat 1023 is electrically connected to the other of the positive and negative electrodes of the battery 1022. Specifically, the connecting member 22 is detachably connected to the cartridge connecting seat 1023. In this embodiment, the connecting member 22 is connected to the cartridge connecting seat 1023 by threads. It can be understood that, in other embodiments not shown, the connecting member 22 and the cartridge connecting seat 1023 can also be detachably connected by means of snapping, plugging, or magnetic connection, which is not limited here. When the connecting assembly 20, the atomizing assembly 30 and the power supply device 102 are installed in place, the atomizing assembly 30 is at least partially received in the space between the lower end of the connecting member 22 and the upper end of the cartridge connecting seat 1023, one pin 331 of the heating member 33 is in contact with and electrically connected to the first electrode 1024, the other pin 331 of the heating member 33 is in contact with and electrically connected to the cartridge connecting seat 1023, so that the heating member 33 is electrically connected to the power supply device 102. In addition, an insulating member (not labelled) is sandwiched between the first electrode 1024 and the cartridge connecting seat 1023, and the insulating member provides an electrical isolation function to avoid short circuit. It can be understood that, the material of the insulating member is an insulating material such as rubber or silicone.

In the electronic cigarette 100 provided in the first embodiment of the present disclosure, when the atomizing assembly 30 needs to be replaced, the atomizing assembly 30 can be taken out by releasing the connection between the connecting assembly 20 and the power supply device 102. Further, it is convenient to disassemble and replace the liquid absorbing member 32 and the heating member 33 of the atomizing assembly 30 individually, which reduces material waste and saves costs. In addition, after the e-liquid in the liquid storage member 10 is used up, the user can drop e-liquid onto the liquid absorbing member 32 after the liquid storage member 10 is pulled out, so that the electronic cigarette 100 can be used continuously to realize the functions of a liquid storage type electronic cigarette and a dripping type electronic cigarette respectively, and the user experience is improved.

Second Embodiment

Figure 6:
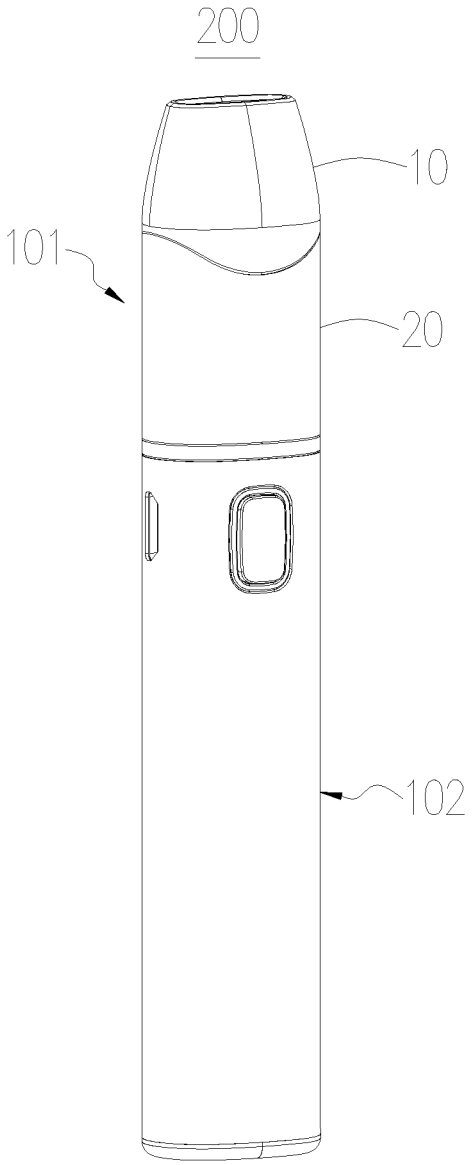
FIG. 6 is a perspective view of an electronic cigarette according of the second embodiment of the present disclosure.
Figure 7:
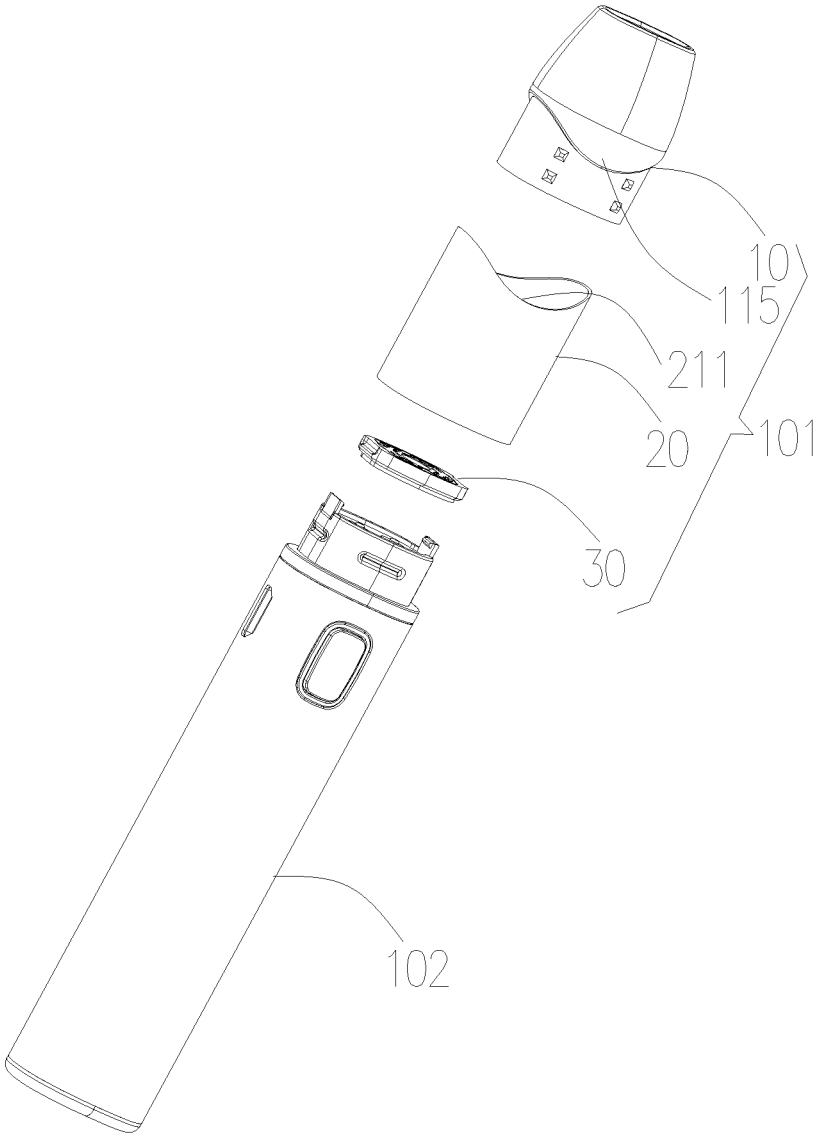
FIG. 7 is a partially exploded view of the electronic cigarette shown in FIG. 6.

Referring to FIGS. 6 and 7, the second embodiment of the present disclosure provides an electronic cigarette 200. The electronic cigarette 200 includes a cartridge 101 and a power supply device 102 electrically connected to the cartridge 101. The cartridge 101 includes a liquid storage assembly 10, a connecting assembly 20 sleeved around the liquid storage assembly 10, and an atomizing assembly 30 received in the connecting assembly 20. The power supply device 102 is connected to the connecting assembly 20. In use, the e-liquid stored in the liquid storage assembly 10 flows into the atomizing assembly 30, and the power supply device 102 supplies power to the atomizing assembly 30, so that the e-liquid is heated by the atomizing assembly 30 to generate smoke, and the smoke can be inhaled by the user, wherein the connecting assembly 20, the atomizing assembly 30 and the power supply device 102 jointly constitute an atomizing device (not labelled).

Figure 8:
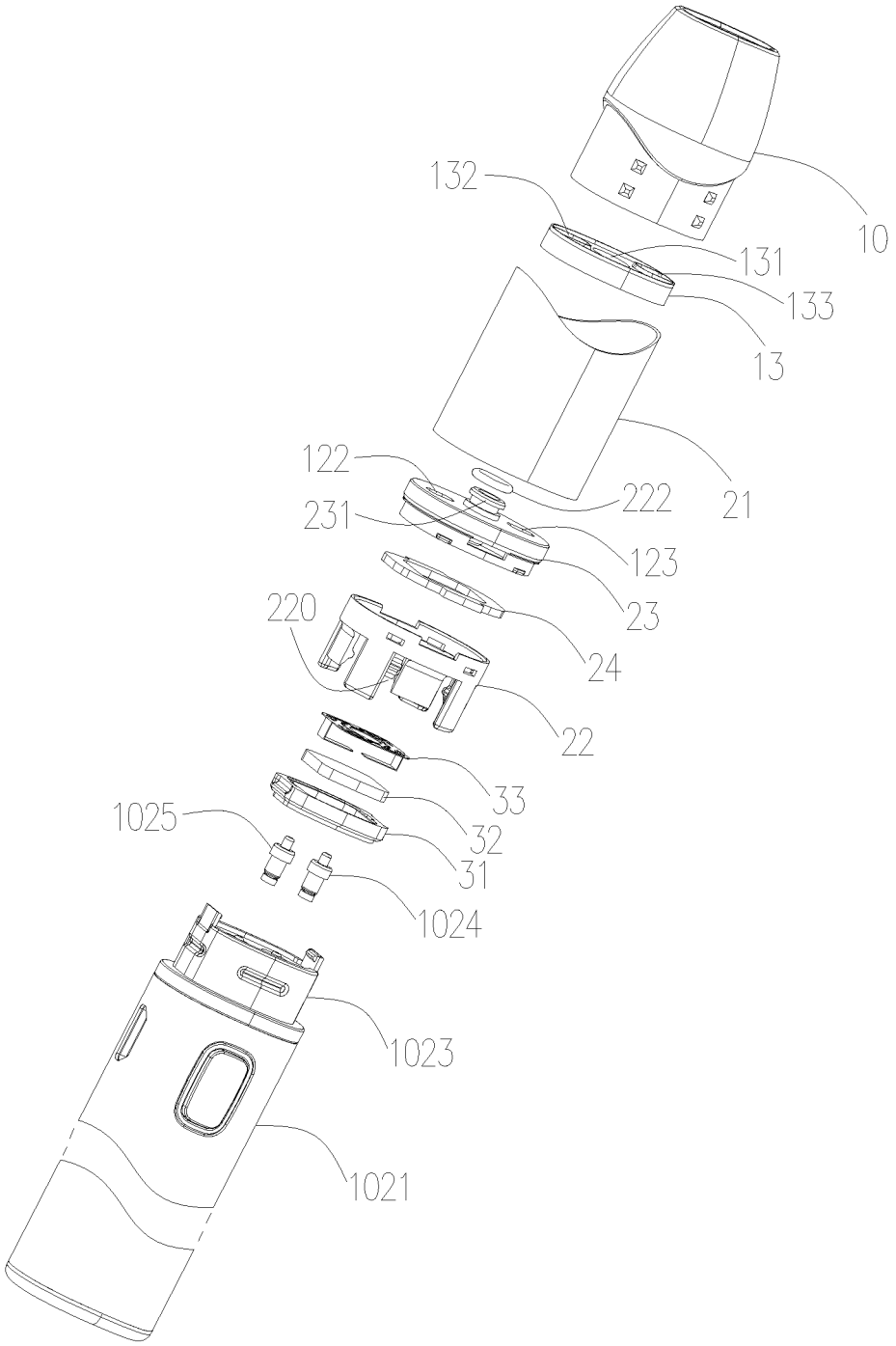
FIG. 8 is another partially exploded view of the electronic cigarette shown in FIG. 6.
Figure 9:
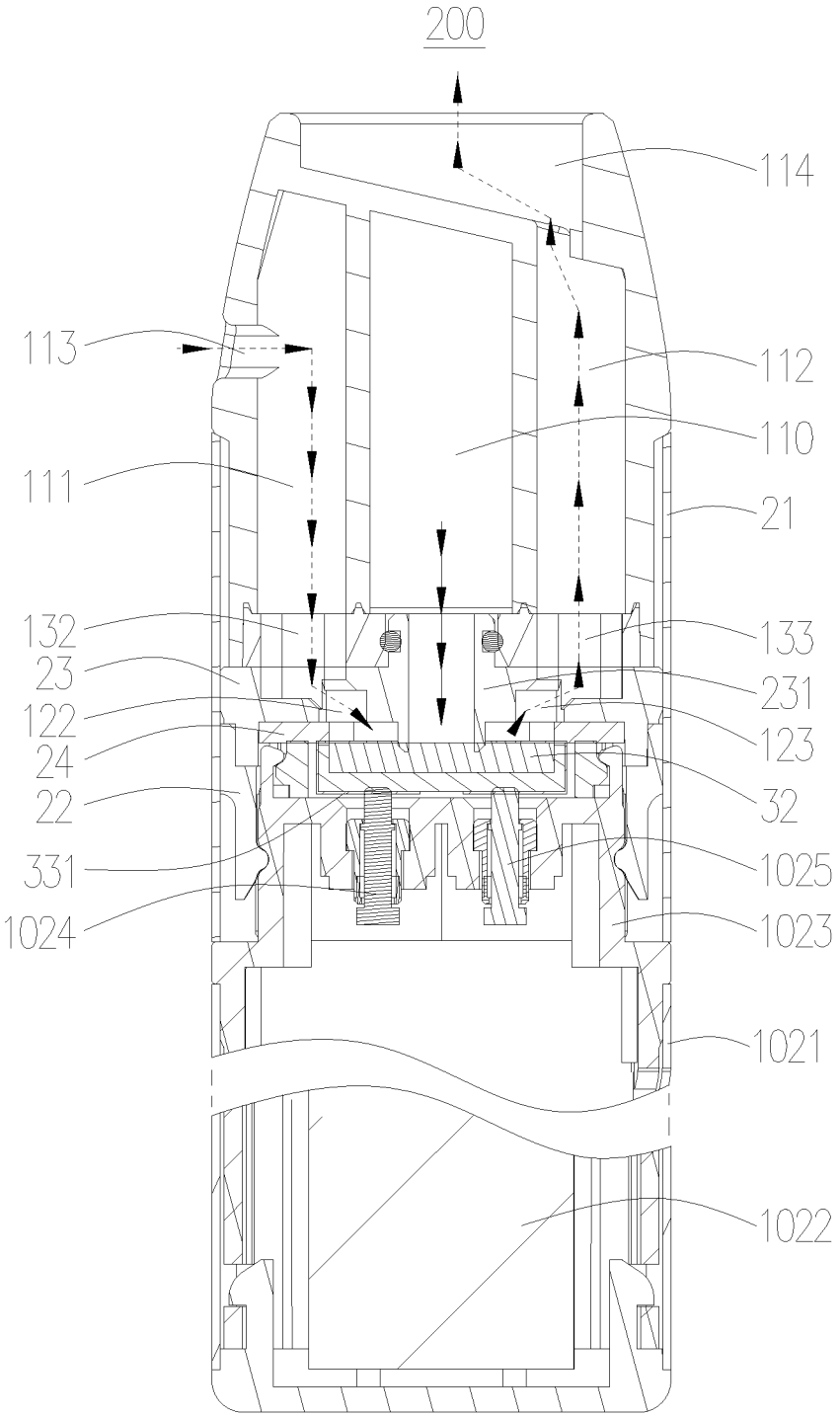
FIG. 9 is a cross-sectional view of the electronic cigarette shown in FIG. 6.

Please refer to FIGS. 6, 8, and 9, in this embodiment, the connecting assembly 20 of the atomizing device for electronic cigarettes includes a connecting sleeve 21 with a cavity therein and a cartridge connecting seat 1023 connected to one end of the power supply device 102. The connecting sleeve 21 is detachably connected to the cartridge connecting seat 1023, for example, by means of snapping connection or threaded connection, etc. The upper end of the connecting sleeve 21 and the upper end of the cartridge connecting seat 1023 are spaced apart along the longitudinal axis of the power supply device 102. The atomizing assembly 30 is at least partially received in the space between the upper end of the connecting sleeve 21 and the upper end of the cartridge connecting seat 1023. The upper end, lower end, etc. mentioned herein refer to the reference direction in normal use of the electronic cigarette, for example, when the electronic cigarette is placed on the desktop or held by the user, rather than an absolute definition.

Please refer to FIG. 8, the liquid storage assembly 10 includes a liquid storage tube 11 and a tail cap 13 provided at the lower end of the liquid storage tube 11.

Figure 10:
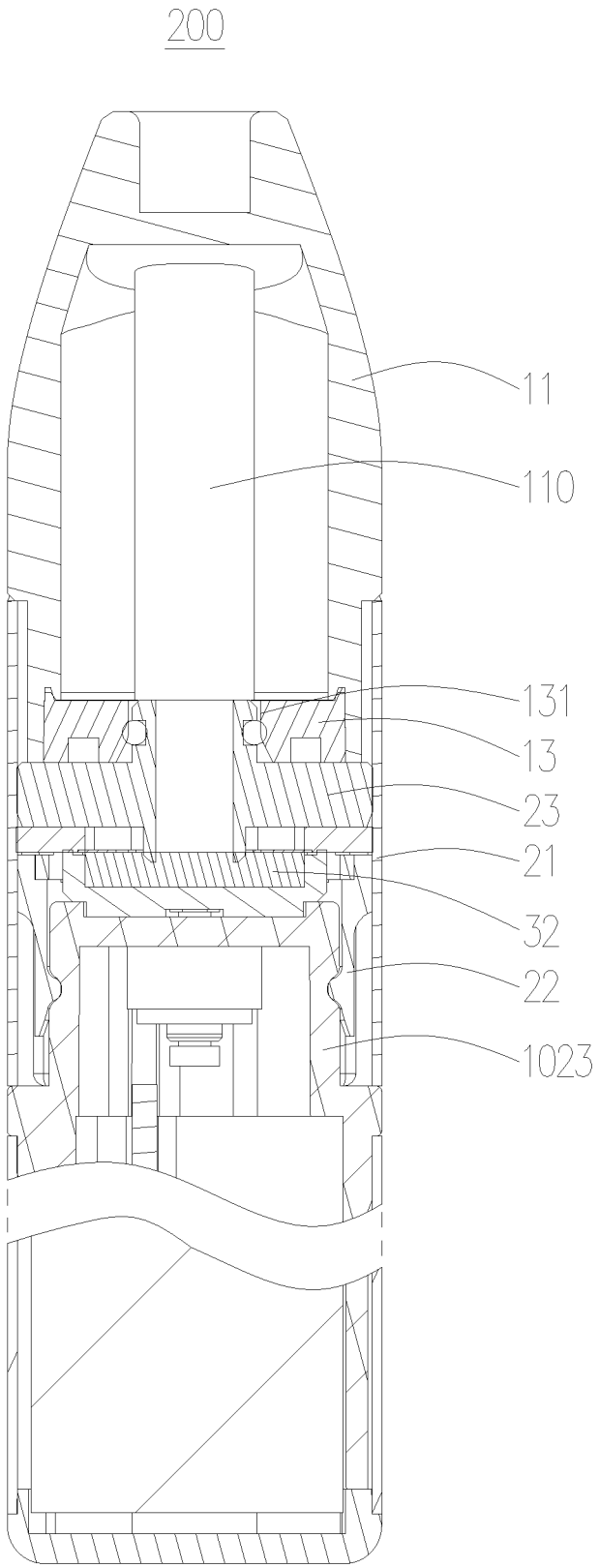
FIG. 10 is another cross-sectional view of the electronic cigarette shown in FIG. 6 (rotated by 90° with respect to FIG. 9).

Please refer to FIG. 9 and FIG. 10, the liquid storage tube 11 substantially has a cylindrical structure, the center portion of the lower end surface of the liquid storage tube 11 is recessed upward along the axial direction of the liquid storage tube 11 to form a liquid storage chamber 110 for storing e-liquid. The upper end of the liquid storage chamber 110 is closed, and the lower end of the liquid storage chamber 110 is an open end. An air inlet passage 111 and an air outlet passage 112 are further provided in the liquid storage tube 11 along the axial direction of the liquid storage tube 11. The air inlet passage 111 and the air outlet passage 112 are located at two opposite sides of the liquid storage chamber 110 which is centrally provided in the liquid storage tube 11. The air inlet passage 111 and the air outlet passage 112 are each spaced apart from the liquid storage chamber 110. The side wall of the liquid storage tube 11 is provided with an air inlet hole 113 along the radial direction of the liquid storage tube 11. An air outlet hole 114 is provided on the upper end surface of the liquid storage tube 11. The air inlet hole 113 is in communication with the outside atmosphere and the upper end of the air inlet passage 111, and the lower end of the air inlet passage 111 extends through the lower end surface of the liquid storage tube 11. The lower end of the air outlet passage 112 extends through the lower end surface of the liquid storage tube 11, and the upper end of the air outlet passage 112 is in communication with the air outlet hole 114. When the user inhales, the outside air enters through the air inlet hole 113, and then sequentially passes through the air inlet passage 111 and the air outlet passage 112, and finally the generated smoke is brought into the user's mouth through the air outlet hole 114.

It can be understood that, during the user's suction process, the hot airflow in the air outlet passage 112 can preheat the e-liquid in the liquid storage chamber 110, so that the e-liquid has a relatively high temperature before it enters the atomizing assembly 30, which can enhance the e-liquid atomizing efficiency and reduce energy consumption at the same time.

The tail cap 13 is substantially in the shape of a circular plate. The tail cap 13 is provided with a liquid outlet through hole 131 in communication with the liquid storage chamber 110, an air inlet through hole 132 in communication with the air inlet passage 111, and an air outlet through hole 133 in communication with the air outlet passage 112. A sealing member (not labelled) is installed in the liquid outlet through hole 131, the sealing member is arranged along the radial direction of the liquid outlet through hole 131 and seals the opening in the lower end of the liquid storage chamber 110. When the sealing member is pierced under the action of an external force, the e-liquid in the liquid storage chamber 110 can flow out through the liquid outlet through hole 131.

In this embodiment, the connecting assembly 20 includes a connecting sleeve 21, and a connecting member 22 and an end cover 23 both of which are received in the connecting sleeve 21, wherein the end cover 23 is connected to the connecting member 22 and is located above the connecting member 22.

The connecting sleeve 21 is substantially a hollow cylindrical structure with both ends being opened. The connecting sleeve 21 is sleeved around the lower end of the liquid storage tube 11. When installing the liquid storage assembly 10, only the lower end of the liquid storage tube 11 needs to be inserted into the connecting sleeve 21. In addition, one of the inner wall of the connecting sleeve 21 and the outer wall of the liquid storage tube 11 is provided with a locking protrusion (not labelled), the other one is provided with a locking groove (not labelled) to be engaged with the locking protrusion. The engagement relationship between the locking protrusion and the locking groove further improves the connection stability between the connecting assembly 20 and the liquid storage assembly 10.

Refer to FIG. 9, the end cover 23 is installed in the lower end of the connecting sleeve 21 by interference fit. The end cover 23 is substantially in a circular plate-like structure. A connecting tube 231 is inserted in the center of the end cover 23. Two ends of the connecting tube 231 are opened to be aligned with the liquid outlet through hole 131. In addition, the end cover 23 is provided with a first through hole 122 and a second through hole 123 therein, wherein the first through hole 122 is in communication with the air inlet through hole 132, and the second through hole 123 is in communication with the air outlet through hole 133.

The connecting member 22 has a substantially cylindrical structure with both ends being opened. The inner cavity of the connecting member 22 forms a receiving groove 220. The atomizing assembly 30 is received in the receiving groove 220. The lower end of the end cover 23 is inserted into the connecting member 22, and the connecting tube 231 abuts against the atomizing assembly 30, so that the e-liquid in the liquid storage chamber 110 can flow into the atomizing assembly 30 through the connecting tube 231 and is heated to generate smoke. In order to improve the connection stability between the connecting member 22 and the end cover 23, the connecting member 22 and the end cover 23 are connected by engaging.

In addition, the lower end of the connecting member 22 is engaged with the upper end of the power supply device 102, so as to achieve a fixed connection relationship between the connecting assembly 20 and the power supply device 102. It can be understood that, in other embodiments not shown, the connecting member 22 and the power supply device 102 may also be connected in a detachable manner such as threaded connection, plugging connection, or magnetic connection, which is not limited here.

Refer to FIG. 7, the connecting sleeve 21 is provided with a notch 211, and the notch 211 extends from the upper end of the connecting sleeve 21 towards the lower end of the connecting sleeve 21. After the liquid storage assembly 10 is installed on the connecting assembly 20, the e-liquid in the liquid storage assembly 20 can be observed through the notch 211. For example, a window 115 is provided on the liquid storage assembly 10, only the window 115 on the liquid storage assembly 10 is made of transparent or translucent material, the rest parts are in black or other dark colors and cannot be seen from the outside. After the liquid storage assembly 10 is installed on the connecting assembly 20, due to the existence of the notch 211, the window 115 on the liquid storage assembly 10 is matched with the notch 211, the e-liquid in the liquid storage assembly 10 can be observed from the outside through the notch 211 and the window 115 to determine whether the liquid storage assembly 10 needs to be discarded and replaced with a new liquid storage assembly 10.

When the liquid storage assembly 10 is connected to the connecting assembly 20, the connecting tube 231 is inserted into the liquid outlet through hole 131 and pierces the sealing member, the e-liquid in the liquid storage chamber 110 can flow into the atomizing assembly 30 through the liquid outlet through hole 131. In this embodiment, the sealing member is a plastic film, the plastic film cannot be repaired after being pierced. After the e-liquid is used up, the liquid storage assembly 10 can be replaced with a new one. It can be understood that, in other embodiments not shown, the sealing member is rubber, the sealing member is provided with a cutout. In a natural state, the cutout is automatically closed to seal the liquid storage chamber 110. When the connecting tube 231 passes through the cutout, the cutout is pushed to open, thereby opening the liquid storage chamber 110. Therefore, when the e-liquid is not used up, the user can detach the liquid storage assembly 10 at any time to prevent the e-liquid from continuously contacting with the atomizing assembly 30 and further damage the atomizing assembly 30. In addition, in order to avoid leakage of the e-liquid from the gap between the tail cap 13 and the end cover 23, a sealing ring 222 is sandwiched between the inner wall of the liquid outlet through hole 131 and the outer wall of the connecting tube 231. The material of the sealing ring 222 includes but is not limited to silicone or rubber.

The atomizing assembly 30 includes an atomizing base 31, a liquid absorbing member 32 received in the atomizing base 31, and a heating member 33 installed on the atomizing base 31. The structure and connection relationship of the atomizing base 31, the liquid absorbing member 32 and the heating member 33 are the same as those of the first embodiment, and will not be repeated herein. In this embodiment, the main difference is that the atomizing assembly 30 and the power supply device 102 are detachably connected.

Please refer to FIG. 9 again, the power supply device 102 includes a casing 1021, a battery 1022 received in the casing 1021, a cartridge connecting seat 1023 installed at one end of the casing 1021, and a first electrode 1024 and a second electrode 1025 installed on the cartridge connecting seat 1023. The connecting member 22 is engaged with the outer surface of the cartridge connecting seat 1023. The atomizing base 31 of the atomizing assembly 30 is engaged with the inner surface of the cartridge connecting seat 1023. The first electrode 1024 is electrically connected to one of the positive and negative electrodes of the battery 1022, and the second electrode 1025 is electrically connected to the other one of the positive and negative electrodes of the battery 1022. When the connecting assembly 20, the atomizing assembly 30 and the power supply device 102 are installed in place, one pin of the heating member 33 is in contact with and electrically connected to the first electrode 1024, the other pin 331 of the heating member 33 is in contact with and electrically connected to the second electrode 1025, thereby achieving an electrical connection relationship between the heating member 33 and the power supply device 102. In addition, an insulating member (not shown) is sandwiched between each of the first electrode 1024 and the second electrode 1025 and the cartridge connecting seat 1023, and the insulating member provides an electrical isolation function to avoid short circuit. It can be understood that, the material of the insulating member is an insulating material such as rubber or silicone.

In addition, please refer to FIG. 8 and FIG. 9 again, a sealing gasket 24 is sandwiched between the end cover 22 and the atomizing base 31. The sealing gasket 24 is provided with a through opening (not labelled) corresponding to the liquid absorbing member 32. The through opening is in communication with the first through hole 122 and the second through hole 123. The connecting tube 231 passes through the through opening and abuts against the liquid absorbing member 32, so that the liquid storage chamber 110 and the liquid absorbing member 32 are in fluid communication with each other. The sealing gasket 24 can prevent gas leakage. The material of the sealing gasket 24 includes, but is not limited to, silicone or rubber.

In use, the e-liquid in the liquid storage chamber 110 is absorbed by the liquid absorbing member 32 through the connecting tube 231, and smoke is generated under the heating of the heating member 33. The external air enters through the air inlet hole 113, passes through the air inlet passage 111, the air inlet through hole 132 and the first through hole 122 in sequence, then flows through the upper end surface of the liquid absorbing member 32, thereafter passes through the second through hole 123, the air outlet through hole 133 and the air outlet passage 112 in sequence, and finally enters the user's mouth through the air outlet hole 114. The direction indicated by the dashed arrows in FIG. 9 is the airflow direction, and the direction indicated by the solid arrows in FIG. 9 is the flow direction of the e-liquid.

In the electronic cigarette 200 provided in the second embodiment of the present disclosure, when the atomizing assembly 30 needs to be replaced, the atomizing assembly 30 can be taken out by releasing the connection between the connecting assembly 20 and the power supply device 102. Further, it is convenient to disassemble and replace the liquid absorbing member 32 and the heating member 33 of the atomizing assembly 30 individually, which reduces material waste and saves costs. In addition, when the e-liquid in the liquid storage member 10 is used up, the user can drop e-liquid onto the liquid absorbing member 32 after the liquid storage member 10 is pulled out, so that the electronic cigarette 200 can be used continuously to realize the functions of a liquid storage type electronic cigarette and a dripping type electronic cigarette respectively, and the user experience is improved.

The above embodiments merely represent several implementations of the present application, and the descriptions thereof are more specific and detailed, but they shall not be understood as a limitation on the scope of the present application. It should be noted that, for those of ordinary skill in the art, variations and improvements may still be made without departing from the concept of the present application, and all of which shall fall into the protection scope of the present application. Therefore, the scope of protection of the present application shall be subject to the appended claims.

What is claimed is:

1. A cartridge comprising a connecting assembly, an atomizing assembly, and a liquid storage assembly provided with a liquid storage chamber therein, wherein the connecting assembly is connected to a lower end of the liquid storage assembly, the atomizing assembly is received in the connecting assembly, the atomizing assembly comprises an atomizing base, a liquid absorbing member and a heating member, an upper end surface of the atomizing base is recessed downward to form a mounting groove, the liquid absorbing member is received in the mounting groove, the heating member is located above the mounting groove of the atomizing base corresponding to the liquid absorbing member, and the heating member presses and fixes the liquid absorbing member in the mounting groove, the liquid storage chamber is in fluid communication with the liquid absorbing member.

2. The cartridge according to claim 1, wherein the atomizing base is provided with a mounting hole on one side of the mounting groove, the heating member is connected with a pin corresponding to the mounting hole, one end of the pin passes through the mounting hole and is bent.

3. The cartridge according to claim 1, wherein the liquid absorbing member has a size substantially the same as the mounting groove such that the liquid absorbing member is fittingly received in the mounting groove, the heating member has a sheet-like structure, and the heating member abuts against an upper end surface of the liquid absorbing member.

4. The cartridge according to claim 1, wherein the atomizing base is provided with two mounting holes on opposite sides of the mounting groove, two pins extend downward from two ends of the heating member, each pin corresponds to one mounting hole, the two pins pass through the two mounting holes and are bent in facing directions to be attached to a lower end surface of the atomizing base.

5. An electronic cigarette comprising a cartridge according to claim 1.

6. The electronic cigarette according to claim 5, wherein the electronic cigarette further comprises a power supply device, the power supply device is electrically connected to the atomizing assembly, the connecting assembly is detachably connected to the power supply device.

7. The cartridge according to claim 1, wherein the connecting assembly comprises a connecting sleeve and a connecting member received in the connecting sleeve, the connecting sleeve is sleeved around the liquid storage assembly, a receiving groove is provided in the connecting member, the atomizing base is received in the receiving groove.

8. The cartridge according to claim 7, wherein the liquid storage assembly comprises an end cover, the end cover is provided with a connecting tube, one end of the connecting tube is in communication with the liquid storage chamber, the other end of the connecting tube passes through the connecting member and abuts against the liquid absorbing member.

9. The cartridge according to claim 7, wherein the liquid storage assembly comprises a tail cap, the connecting assembly further comprises an end cover connected with the connecting member, the end cover is provided with a connecting tube, one end of the connecting tube is inserted into the tail cap and is in communication with the liquid storage chamber, the other end of the connecting tube abuts against the liquid absorbing member.

10. The cartridge according to claim 9, wherein the tail cap is provided with a liquid outlet through hole, a sealing member for sealing the liquid storage chamber is installed in the liquid outlet through hole, after one end of the connecting tube is inserted into the liquid outlet through hole and passes through the sealing member, the liquid storage chamber is in communication with the connecting tube.

11. The cartridge according to claim 7, wherein the liquid storage assembly comprises a liquid storage tube, the connecting sleeve is sleeved around the liquid storage tube, the liquid storage tube is provided with an air inlet passage and an air outlet passage therein, the air inlet passage and the air outlet passage are each spaced apart from the liquid storage chamber, the liquid storage tube is further provided with an air inlet hole and an air outlet hole, the air inlet passage is in communication with the air inlet hole and the receiving groove, the air outlet passage is in communication with the air outlet hole and the receiving groove.

12. The cartridge according to claim 11, wherein the connecting member is provided with a U-shaped connecting passage therein, two opposite ends of the connecting passage are respectively in communication with the air inlet passage and the air outlet passage, the lower end of the connecting passage is in communication with the receiving groove, a portion of the air inlet passage and a portion of the air outlet passage are blocked by the part of the connecting member that is surrounded by the connecting passage.

13. An atomizing device for electronic cigarettes comprising a power supply device, an atomizing assembly and a connecting assembly, wherein the connecting assembly comprises a connecting sleeve with a cavity therein and a cartridge connecting seat connected to one end of the power supply device, the connecting sleeve is detachably connected to the cartridge connecting seat, an upper end of the connecting sleeve and an upper end of the cartridge connecting seat are spaced apart along a longitudinal axis of the power supply device, the atomizing assembly is at least partially received in the space between the upper end of the connecting sleeve and the upper end of the cartridge connecting seat;

the connecting assembly further comprises a connecting member received in the connecting sleeve, the connecting member is detachably connected to the cartridge connecting seat, the atomizing assembly is at least partially received in the space between a lower end of the connecting member and the upper end of the cartridge connecting seat;

the atomizing assembly comprises an atomizing base received in the space between the lower end of the connecting member and the upper end of the cartridge connecting seat, and a heating member installed on the atomizing base, the power supply device further comprises a battery, two ends of the heating member are electrically connected to the positive and negative electrodes of the battery, respectively.

14. The atomizing device for electronic cigarettes according to claim 13, wherein a lower end surface of the connecting member is recessed upward to form a receiving groove, the atomizing assembly is received in the receiving groove, the connecting member and the cartridge connecting seat are connected by threads.

15. The atomizing device for electronic cigarettes according to claim 13, wherein an inner cavity of the connecting member forms a receiving groove, the atomizing assembly is engaged with an inner surface of the cartridge connecting seat, the connecting member is engaged with an outer surface of the cartridge connecting seat.

16. An electronic cigarette comprising an atomizing device for electronic cigarettes according to claim 13.

17. The electronic cigarette according to claim 16, wherein the electronic cigarette further comprises a liquid storage assembly detachably connected with the connecting assembly, the liquid storage assembly comprises a liquid storage tube, the outer circumferential surface of the liquid storage tube is protruded to provide with a limiting portion, the upper end of the connecting sleeve is engaged with the limiting portion, the connecting sleeve is sleeved around the liquid storage tube, the upper end of the connecting sleeve abuts against the limiting portion.

18. The electronic cigarette according to claim 17, wherein one of the inner wall of the connecting sleeve and the outer wall of the liquid storage tube is provided with a locking protrusion, the other one is provided with a locking groove to be engaged with the locking protrusion.

19. The electronic cigarette according to claim 17, wherein the liquid storage tube is provided with a liquid storage chamber therein, the atomizing assembly comprises a liquid absorbing member, a connecting tube is provided between the liquid storage tube and the atomizing assembly, one end of the connecting tube is in communication with the liquid storage tube, the other end of the connecting tube abuts against the liquid absorbing member.

20. The electronic cigarette according to claim 19, wherein the liquid storage assembly is provided with a liquid outlet through hole in communication with the liquid storage chamber, a sealing member for sealing the liquid storage chamber is installed in the liquid outlet through hole, when the liquid storage assembly and the connecting assembly are installed in place, the connecting tube is inserted into the liquid outlet through hole and passes through the sealing member, the liquid storage chamber is in communication with the connecting tube.

* * * * *